United States Patent [19]

Maybee

[11] 4,188,604

[45] Feb. 12, 1980

[54] THERMOSTAT REGULATOR

[75] Inventor: Richard C. Maybee, Burlington, Canada

[73] Assignee: Polygauge Industries Ltd., Oakville, Canada

[21] Appl. No.: 842,563

[22] Filed: Oct. 17, 1977

[51] Int. Cl.[2] ..... H01H 37/16

[52] U.S. Cl. ..... 337/377; 236/68 B

[58] Field of Search ..... 337/377, 102; 236/68 B, 236/46 R

[56] References Cited

U.S. PATENT DOCUMENTS

| | | | |
|---|---|---|---|
| 3,834,618 | 9/1974 | Buckwalter | 337/377 |
| 4,014,500 | 3/1977 | Galtz | 337/377 |

*Primary Examiner*—Harold Broome

*Attorney, Agent, or Firm*—Sim & McBurney

[57] ABSTRACT

There is provided a regulator for wall thermostats. The regulator is operated by a timer, and provides a warm air stream upwardly beneath a thermostat to cause the thermostat to lower the house temperature between specific hours, such as at night, and cuts off the warm air stream for the remainder of the day. A housing defines an air passage which has manual means for restricting it to a greater or lesser degree. Illumination and heating means are provided within the housing which simultaneously heats the air to promote convective flow upwardly, and illuminates the manual means.

7 Claims, 5 Drawing Figures

THERMOSTAT REGULATOR

This invention relates generally to a thermostatic control of temperature in enclosed spaces, and has to do particularly with the provision of a regulator for wall thermostats.

The scarcity and expense of energy sources in recent years has led to the desirability of avoiding the waste of energy whenever possible. One way in which this can be done is to reduce the amount of fuel or electrical energy required to heat houses and other human accommodation. At night, when the residents of a house are asleep, it does not produce discomfort to lower the temperature in the house by five or ten degrees. Many house owners have developed the habit of turning down the thermostat before retiring for the night, and then turning it up again in the morning. This leads to some discomfort, because of the necessity for getting out of bed in a cold house.

The present invention provides an automatic timing device which can automatically regulate the temperature in a house or other living space, by causing a flow of heated air to pass upwardly under the thermostat beginning at a pre-selected time in the evening, and ending at a pre-selected time in the morning. The upward flow of warm air in effect "fools" the thermostat into thinking that the temperature in the room is warmer than it actually is, and therefore the thermostat does not call for heat. This allows the room temperature to drop to a level which is dependent upon the flow characteristics for the heated air, and the temperature rise in the heated air which the device can accomplish.

According, this invention provides a regulator for wall thermostats, comprising:

- a housing adapted to be affixed to a wall under a thermostat, the housing defining within it a passage for air, the passage having an inlet and an outlet with the inlet situated below the outlet,
- a manually rotatable member at least partly translucent and mounted to the housing in the path defined by said passage, the rotatable member defining a passageway which may be adjusted by rotating the member to positions between that of alignment with said passage and that of blocking said passage,
- and means including a light source within the passageway of the member for simultaneously (a) heating the air within said passageway thus promoting convective flow from the inlet to the outlet, and (b) illuminating said rotatable member.

One embodiment of this invention is illustrated in the accompanying drawings, in which like numerals denote like parts throughout the several views, and in which.

Figure 1:
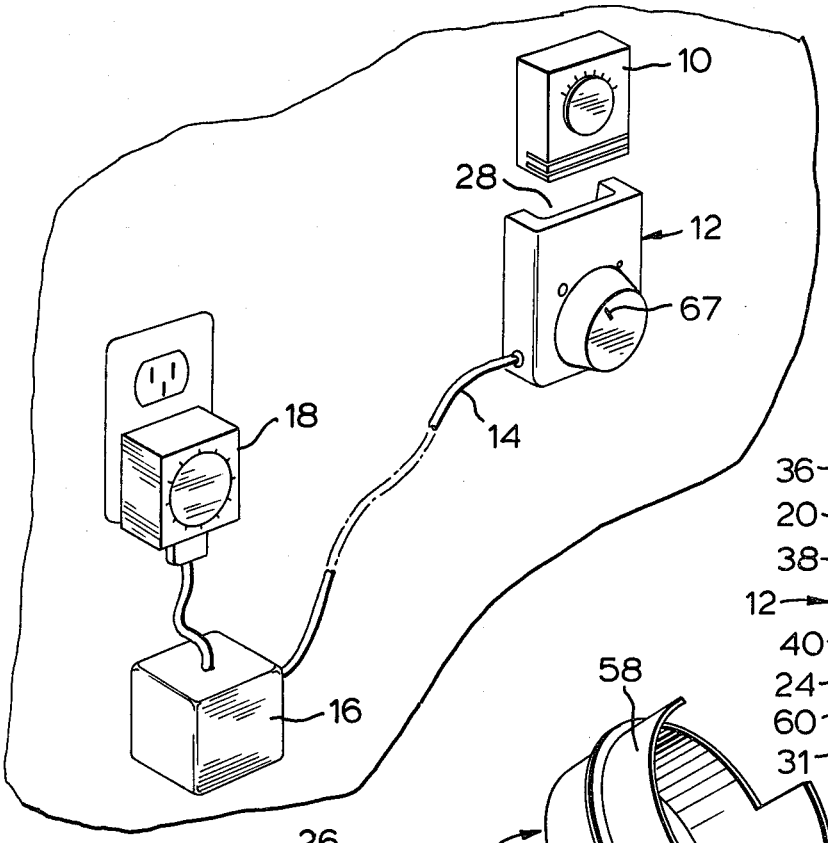
FIG. 1 is a perspective view of the regulator of this invention in association with a thermostat, and power-supply components.

Turning first to FIG. 1, there is shown a conventional thermostat 10 mounted on a wall, directly beneath which is located a regulator 12 constructed in accordance with this invention.

An electric wire 14 carries electric power from a transformer 16 to the regulator 12, and a conventional plug-in type timer 18 allows electrical power to be fed to the regulator 12 between specific pre-set times of day. The timer 18 is one which is adapted to plug directly into a wall socket, and which provides its own socket into which other appliances may be plugged. The socket in the timer itself becomes "live" and "dead" at the specific pre-set times.

Turning now to the remaining figures, the regulator 12 is seen to include a housing 20 which is adapted to be affixed to the wall, for example by recessed plaster screws (not shown).

Figure 2:
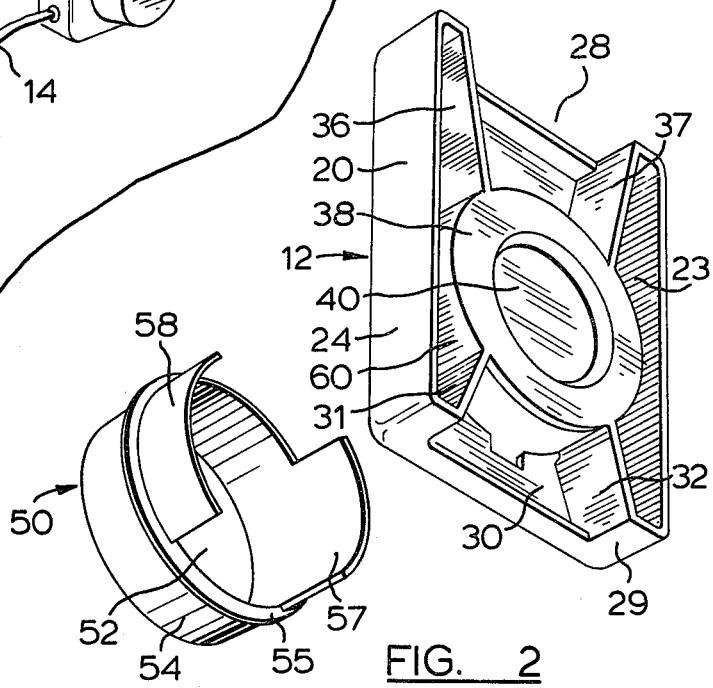
FIG. 2 is an exploded view of the regulator taken from the rear and below.
Figure 3:
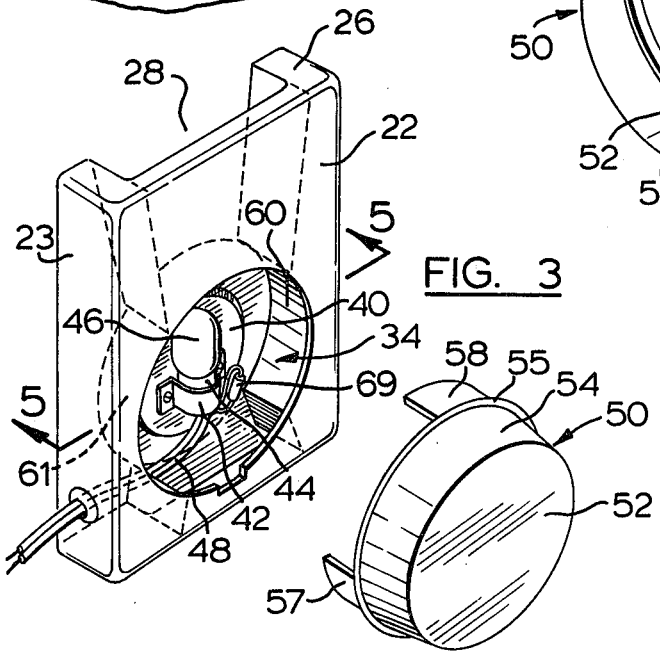
FIG. 3 is an exploded view of the regulator, taken from in front and above.

As seen in FIGS. 2 and 3, the housing includes a forward face 22 of rectangular configuration, side walls 23 and 24, a top wall 26 which is C-shaped in configuration and defines a recess opening 28 which is spaced from the forward face 22 and the side walls 23 and 24. The housing also includes a bottom wall 29 exactly identical to the top wall 26, and thus defining a similar recess 30.

When the housing is affixed to a wall, the recess 30 at the bottom of the housing defines an inlet for an air passage which begins at the recess 30, extends upwardly between two inwardly converging partitions 31 and 32, continues upwardly through a cylindrical cavity 34 best seen in FIG. 3, thence further upwardly between two diverging partitions 36 and 37, and finally to the upper recess 28 which constitutes the outlet for air moving through the passage. The cylindrical recess opens freely through the forward face 22 of the housing, and is limited rearwardly by a substantially circular partition 38 which has a central raised portion 40 (raised toward the front as can be seen in FIG. 3). Mounted on the raised portion 40 by virtue of a bracket 42 is a bulb socket 44 in which a light bulb 46 is received. The two electric wires 48 which feed power to the light bulb 46 are of course the same as the wire 14 shown in FIG. 1.

The cylindrical pocket 34 is adapted to be closed forwardly by a knob 50 best seen in FIGS. 2 and 3. The knob 50 has a circular forward wall 52, a frusto-conical side wall 54, a bead 55 at the large-diameter end of the frusto-conical side wall 54, and two part-cylindrical partitions 57 and 58, each covering about 90° of arc, and being spaced apart by intervals of about 90°.

The knob constitutes damper means for selectively and manually restricting the air passage. For example, it can be readily visualized that if the exploded view of FIG. 2 were to be assembled together with the knob 50 in the same configurational relationship as it is shown in that figure, the two 90° openings between the partitions 57 and 58 would be in line with the air passage in the housing extending from the recess 30 to the recess 28, and air flow through the passage would be unrestricted. However, by rotating the knob 50 through various angles to bring the partitions 57 and 58 into a greater or lesser restricting relationship with the air passage through the housing, the ability of air to flow freely through the passage can be controlled. By setting the partitions 57 and 58 directly across the air passage (i.e. by rotating the knob 50 through 90° from its position shown in FIG. 2), all air flow through the passage could be halted.

It will be readily understood that by energizing the light bulb 46, the air within the passage (which includes the cavity where the light bulb 46 is located) will be heated, and convective forces will cause the air to rise. This will initiate a steady upward flow of air through the air passage, with constant heating of the air as it rises. The warmer air passing upwardly through the recess 28 will engulf the thermostat 10, thus fooling the thermostat into thinking that the room is warmer than it actually is.

Figure 4:
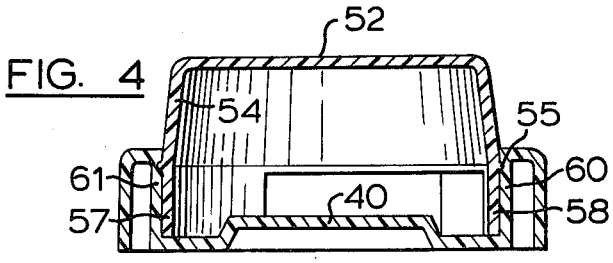
FIG. 4 is a transverse sectional view taken at the line 4—4 in FIG. 5.
Figure 5:
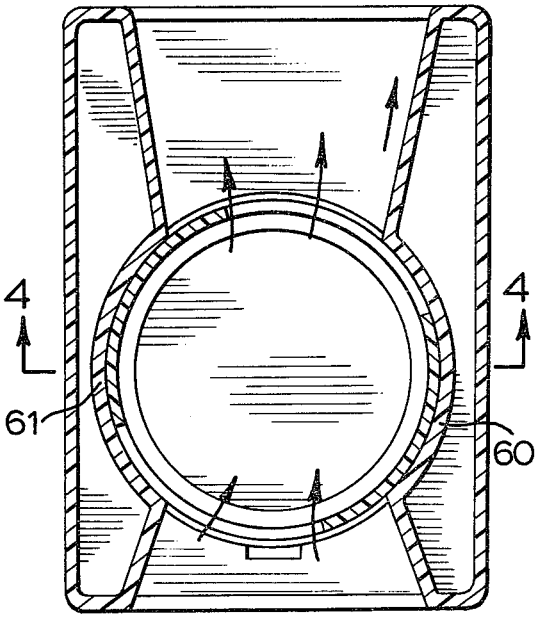
FIG. 5 is a vertical sectional view taken at the line 5—5 in FIG. 3.

To allow the knob 50 to be retained in position against the housing 10, the bead 55 is adapted to lodge in a corresponding recess provided in part cylindrical walls 60 and 61. This relationship is visible in FIG. 4.

At least some projecting portion of the knob 50 is non-opaque to the light given off by the light bulb 46. This may include the forward wall 52 of the knob 50, the frusto-conical wall 54, or both portions.

The provision of at least one non-opaque portion on the knob 50 allows the light bulb 46 to accomplish several functions simultaneously. In the first place, of course, the light bulb 46 performs the primary function of heating the air within the housing and promoting the upward flow of air by virtue of convection. A second function of the light bulb 46 is to illuminate the knob 50, so that the same may be located in a darkened room, and moreover may be adjusted without having to turn on additional light sources in the room. The knob 50 would preferably would have a marker arrow or raised portion such as that shown at 67 in FIG. 1, so that the person operating the regulator could determine the setting.

A last function performed by the light bulb 46 is that of a "night light", which many young children require to allow them an undisturbed sleep. Where the thermostat being regulated is located in a child's room (for example in electrically heated dwellings where each room has a separate thermostat), the regulator of this invention provides an automatic night light which comes on at or about the time when the child goes to sleep, and which automatically shuts itself off in the morning when daylight appears.

It is contemplated to utilize a light bulb with a voltage rating greater than the voltage delivered to the light bulb, thereby prolonging the life of the bulb. This can easily be arranged by selecting a transformer 16 of which the output is several volts less than the rating of the bulb. In a satisfactory embodiment of the latter feature, a transformer with an output around 12 volts was utilized along with a bulb rated for 14 volts.

In the preferred embodiment, the entire knob 50 is constructed of a translucent plastic.

A variation of the regulator disclosed herein employs a light bulb in combination with a resistor 69. The resistor 69 is preferably wired in parallel with the bulb, although a series connection is also possible, given appropriately rated components. By providing the resistor 69, a greater amount of the consumed energy is available as heat than would be the case with the bulb used alone.

I claim:

1. A regulator for wall thermostats, comprising:

a housing adapted to be affixed to a wall under a thermostat, the housing defining within it a passage for air, the passage having an inlet and an outlet with the inlet situated below the outlet, a manually rotatable member at least partly translucent and mounted to the housing in the path defined by said passage, the rotatable member defining a passageway which may be adjusted by rotating the member to positions between that of alignment with said passage and that of blocking said passage; the rotatable member including two part-cylindrical partitions each covering about 90° of arc, and being spaced apart by intervals of about 90°, the housing defining a cylindrical guideway in which said partitions can rotate, the guideway being part of said passage, the passage having side walls which intersect the guideway so as to open through about 90° of the cylinder, whereby each partition is able to assume a position in which the passage is completely blocked, and means including a light source within the passageway of the member for simultaneously (a) heating the air within said passageway thus promoting convective flow from the inlet to the outlet, and (b) illuminating said rotatable member.

2. The invention claimed in claim 1 in which said passage is oriented substantially vertically with the inlet at the bottom and the outlet at the top.

3. The invention claimed in claim 1, in which the means for heating and illuminating includes a light source mounted to the housing and a resistor in parallel with the light source, and in which the rotatable member has a translucent circular forward face through which light from said source can pass.

4. The invention claimed in claim 1, which further includes a timer component which can turn the means for heating and illuminating on and off at pre-selected times of day.

5. The invention claimed in claim 1, in which the light source is a light bulb rated above the voltage delivered to it, in order to increase its life.

6. The invention claimed in claim 5, in which a transformer is inserted between the timer and the light bulb, the timer being directly connected to an A.C. source.

7. The invention claimed in claim 1, in which the means for heating and illuminating is a light bulb in parallel with a resistor.

* * * * *